US006678928B2

(12) United States Patent
Wallace

(10) Patent No.: US 6,678,928 B2
(45) Date of Patent: Jan. 20, 2004

(54) APPARATUS AND METHOD FOR PAPER ROLL REFURBISHING

(76) Inventor: Marcus Wallace, 175 Marina La., Winchester, TN (US) 37388

( * ) Notice: Subject to any disclaimer, the term of this patent is extended or adjusted under 35 U.S.C. 154(b) by 0 days.

(21) Appl. No.: 10/131,734

(22) Filed: Apr. 24, 2002

(65) Prior Publication Data

US 2002/0174527 A1 Nov. 28, 2002

Related U.S. Application Data

(60) Provisional application No. 60/293,714, filed on May 25, 2001.

(51) Int. Cl.[7] ..... B21B 15/00; B65B 61/00

(52) U.S. Cl. ..... 29/33 R; 29/564; 53/136.2; 53/211; 53/314

(58) Field of Search ..... 29/33 R, 33 K, 29/564, 564.1, 564.6, 564.7, 564.8; 53/136.2, 211, 214

(56) References Cited

U.S. PATENT DOCUMENTS

| | | | | | |
|---|---|---|---|---|---|
| 3,924,375 | A | | 12/1975 | Brenner et al. | 53/380 |
| 4,137,690 | A | * | 2/1979 | Morgan | 53/176 |
| 4,333,301 | A | * | 6/1982 | Koutonen et al. | 53/587 |
| 4,341,586 | A | | 7/1982 | Koutonen | 156/518 |
| 4,534,151 | A | | 8/1985 | Schneck et al. | 53/415 |
| 4,565,049 | A | * | 1/1986 | DeLigt et al. | 53/415 |
| 4,607,476 | A | * | 8/1986 | Fulton, Jr. | 53/399 |
| 4,723,395 | A | | 2/1988 | Koutonen | 53/587 |
| 4,958,478 | A | * | 9/1990 | Hannen et al. | 53/415 |
| 5,003,753 | A | * | 4/1991 | Dornblaser et al. | 53/415 |
| 5,177,446 | A | * | 1/1993 | Boriani et al. | 324/671 |
| 5,533,321 | A | * | 7/1996 | Hooper et al. | 53/415 |
| 5,546,729 | A | | 8/1996 | Pienta | 53/211 |
| 5,561,971 | A | * | 10/1996 | Sampson | 53/556 |
| 5,642,600 | A | | 7/1997 | Hooper et al. | 53/415 |
| 5,791,119 | A | * | 8/1998 | Pienta | 53/211 |
| 5,983,598 | A | * | 11/1999 | Quinones | 53/409 |
| 5,987,847 | A | * | 11/1999 | Nordstrom et al. | 53/234 |
| 6,070,389 | A | * | 6/2000 | Irvin | 53/397 |

OTHER PUBLICATIONS

Brochure, Dimension 1, Ltd., Australia.

* cited by examiner

*Primary Examiner*—A. L. Wellington
*Assistant Examiner*—Dana Ross
(74) *Attorney, Agent, or Firm*—Waddey & Patterson; David B. Pieper; Phillip E. Walker

(57) ABSTRACT

The apparatus and method for application of a protective covering to an unprotected paper roll in locations without major paper handling equipment is described to provide an inexpensive and portable system for paper roll refurbishing. Apparatus used in the present invention includes: an apparatus for holding the body wrapper supply roll and measuring the unrolled wrapper to a desired length; an apparatus for rewinding and cutting individual wrappers for transport to the point of use; an apparatus for applying the wrappers to the paper roll; an apparatus for transporting the rolls from the resizing area to the wrapping area; and an apparatus for crimping the body wrap over the end of the roll to retain the header; an apparatus for retention of the headers and caps under pressure during curing of the retaining adhesive.

18 Claims, 10 Drawing Sheets

APPARATUS AND METHOD FOR PAPER ROLL REFURBISHING

APPLICATION FOR UNITED STATES LETTERS PATENT

This application claims benefit of co-pending U.S. patent application Ser. No. 60/293,714 filed May 25, 2001, entitled "Paper Roll Refurbishing" which is hereby incorporated by reference.

BACKGROUND OF THE INVENTION

The present invention relates generally to handling large rolls of paper. More particularly, this invention pertains to the application of a protective covering to an unprotected paper roll in locations without major paper handling equipment.

In the printing and paper industry, large rolls of paper are handled and processed. In the course of this processing, rolls are sometimes damaged and must be scrapped or may be salvaged by the process and machine of U.S. Pat. No. 5,964,024, issued to Wallace on Oct. 12, 1999, entitled "Roll-Cutter" which is currently in use in the industry. This patent is hereby incorporated by reference. Often, the paper is simply of the incorrect dimension and may be resized by the roll cutter to a usable size.

When the roll cutter is used to resize a roll, at least one of the headers is removed during the cutting operation. This leaves that end exposed to dirt and possible damage. When the roll is used at the same facility, this exposure is not significant because the duration of storage is usually minimal. However, where long term storage is needed, or when the resized paper roll must be transported to other facilities, the possibility for contamination and damage to the roll is increased. This mandates that a new wrapper, headers, and caps be applied to refurbish the roll.

Paper mills and large paper processing plants are equipped with machinery to apply wrappers and headers to the finished rolls. This machinery is large, complex, very expensive, and is certainly not portable. Large production machinery does not lend itself to small orders such as for samples or incidental damage. During an equipment breakdown at these large facilities, production will cease. In critical situations, this shutdown may have a significant economic impact. In addition, during application of the roll cutter where relatively few rolls of paper are involved, difficulty arises in re-wrapping and applying new headers. Transporting the rolls to a wrapping facility is cost prohibitive and would defeat the purpose of the roll cutter. The present invention provides a method to overcome the limitations on the prior art large production rate equipment.

The prior art roll covering application sequence is shown in FIG. 1, beginning at the left and progressing to the right, where a paper roll 10 is protected by wrapping the paper roll 10 in a with a heavy gauge of paper wrapper 12, also call a body wrap 12, which extends over the ends 18 of the paper roll 10. The edges 14 of the body wrap 12 are then folded over the ends 18 of the paper roll 10. The edges 14 are then unfolded and a disc 16 is inserted between the folded edges 14 and the end 18 of the paper roll 10. The header disc 16 is a circular disc of heavy fibrous (cardboard) material approximating but smaller than the diameter of the roll 10 being refurbished and having a center hole corresponding to the diameter of the core tube. The protective disks 16 or headers 16 are applied to protect the ends 18 of the roll 10 from physical damage. The edges 14 of the wrapper 12 are then crimped back over the header 16 and a seal cap 20 is then applied and retained with adhesive to retain the body wrap 12 and eliminate contamination from dust and dirt. The end seal cap 20 is a circular disc of paper that is bonded to the crimped wrapper 12 to retain the crimp and exclude dirt from the paper roll. The cap 20 does not have a center hole to keep its sealing effect.

Current practices for wrapping small quantities of rolls is to lay the wrapper on the floor and manually roll the paper over the wrapper until it is wound around the roll. An alternative practice is to place the paper roll onto rollers to facilitate turning of the roll during re-wrapping. These rollers press into the wrapper and make it difficult to obtain a tight wrap.

The reconditioning of some rolls requires that the outer layers of paper be removed. Perhaps several inches of paper may need to be removed. The current practice is to slit the roll along its axis with a portable circular saw to the depth that needs to be removed. This creates a problem because rolls may be upwards of seven feet in diameter which will result in a slab of paper over twenty-one feet in length.

Additionally, the body wrap material is supplied on large rolls similar to the paper itself, only in wider dimensions. This presents the added difficulty of cutting the wrapper material to the size needed to handle an individual roll.

What is needed, then, is an apparatus and method to provide an inexpensive and portable system for paper roll refurbishing.

SUMMARY OF THE INVENTION

The present invention is directed to apparatus and methods to provide an inexpensive and portable system for paper roll refurbishing. Apparatus used in the present invention includes: an apparatus for holding the body wrapper supply roll and measuring the unrolled wrapper to a desired length; an apparatus for rewinding and cutting individual wrappers for transport to the point of use; an apparatus for applying the wrappers to the paper roll; an apparatus for crimping the body wrap over the end of the roll to retain the header; an apparatus for transporting the rolls from the resizing area to the wrapping area; and an apparatus for retention of the headers and caps under pressure during curing of the retaining adhesive.

These apparatus provide a system of machines and equipment that provide a comprehensive, low cost, portable system for refurbishing paper rolls.

This present invention provides a support for the body wrap and provides a way to unwind a predetermined length of body wrap material. This material is then rewound in small, easy to handle individual rolls. These pre-cut rolls may be cut to a shorter size and thus eliminate the need to obtain and store wrapper stock of various widths. In this manner, a single roll of wrapper can supply all of the sizes as required.

The present invention overcomes the problems with obtaining a tight wrap by supporting the roll from its center core and providing a powered rotation to overcome the limitations of the prior art.

The present invention provides for support of the roll from its center to elevate the roll to facilitate in removal of the excess or damaged paper, and the application, wrapping, and crimping of the body wrap material.

The present invention provides for an easily transportable roll for portable movement for refurbishing.

The present invention also provides for the retention of the body wrap during a bonding process to obtain a tightly wrapped roll.

A method for using the equipment and apparatus is also provided.

In this manner, the objective of providing improved process flow for each of the actions for refurbishing a paper roll are provided by the present invention.

Other objects and further scope of the applicability of the present invention will become apparent from the detailed description to follow, taken in conjunction with the accompanying drawing wherein like parts are designated by like reference numerals.

DESCRIPTION OF THE PREFERRED EMBODIMENTS

Figure 1:
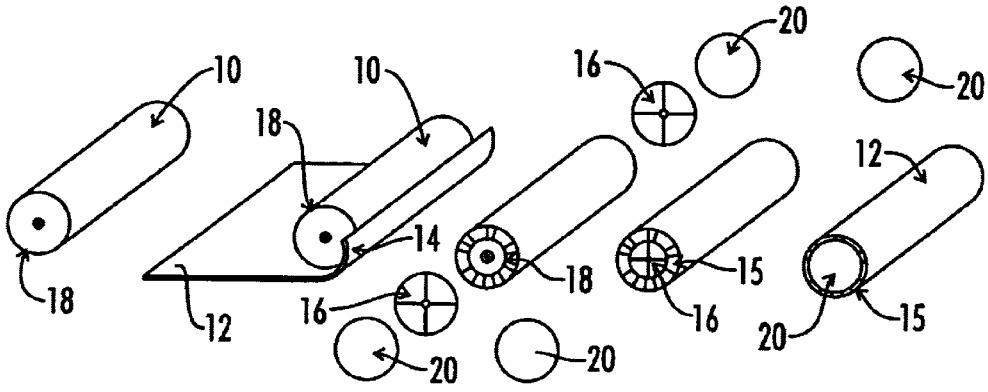
FIG. 1 (Prior Art)
FIG. 1 is a sequential view of the prior art method for wrapping a paper roll.

As shown in FIGS. 2 through 10, the present invention provides a system of machines or equipment to provide a portable refurbishing system for a paper roll. The equipment includes a wrapper supply roll holding, measuring, re-rolling, and cutting station 200; a paper roll wrap station 800; a roll transporter 900, and header and cap damping station 1000.

FIGS. 2 through 5 show the wrapper supply roll holding, measuring, re-rolling, and cutting station 200, also known as the wrapper supply roll station 200. The wrapper supply roll station includes a main frame 202, a loading carriage 204, wrapper roll lifts 214 including a fixed roll lift assembly 206 and a moveable roll lift assembly 208, and a measuring, re-roll and cut station 210.

The main frame 202 is a stationary frame of suitable size for holding the rolls of body wrap material shown as the supply roll 203. Typical supply rolls 203 of body wrapper material are up to seven feet in diameter and 152 inches long. The main frame 202 forms the base of the wrapper supply roll station 200. Within the main frame 202, four longitudinal beams 212 act as structural members to attach and support the wrapper roll lifts 214. Two of these beams 202 act as tracks 216 for a movable loading carriage 204.

The loading carriage 204 receives the roll of supply material 203. The supply roll 203 is placed upon the carriage 204 that has two uprights 218, one on each side, that retain the roll 203 on the carriage frame 220. Rollers 222 mounted to the carriage frame 220 allow the carriage 204 to be moved back and forth along the tracks to the desired position. The loading carriage 204 may be moved along the tracks 216 and positioned for different lengths of supply rolls 203. Once the supply roll 203 is placed on the loading carriage 204, the spindles 226 are vertically adjusted to be placed at the height of the roll core 228 and the roll 203 and carriage 204 are moved to position the wrapper roll 203 such that the roll 203 may be lifted by the roll lifts 214.

Each end of the main frame 202 is equipped with roll lifts 214 for lifting the supply roll 203 off of the carriage 204. The fixed roll lift 206 is fixed in position on the frame 202 while the adjustable roll lift 208 is mounted on wheels 224 that allow the wrapper supply roll station 200 to accommodate various length supply rolls 203. The adjustable lift 208 rides upon the same tracks 216 as the carriage 204.

Each roll lift 214 is equipped with a spindle 226 that inserts into the core 228 of the supply roll 203. The spindle 226 of each lift 214 is attached to a vertically mounted guide plate 234 moving between guide tracks 238. The vertically mounted guide plate 234 is connected to a hydraulic cylinder 236 to provide the controlled vertical movement of the plate 234 within the tracks 238. The cylinders 236 are actuated to raise and lower the supply roll 203. Each lift 214 is equipped with an independent hydraulic power unit that powers the cylinders 236 and in the instance of the fixed lift 206, powers a hydraulic wrapper supply roll rotation motor 230. The spindle 226 of the fixed lift is powered by a hydraulic motor 230 attached to the spindle through a drive 232 so that it can rotate the supply roll 203 for unwinding the wrapper. The spindle 226 of the movable lift 208 acts as an idler and is used to support and lift the supply roll 203.

Figure 2:
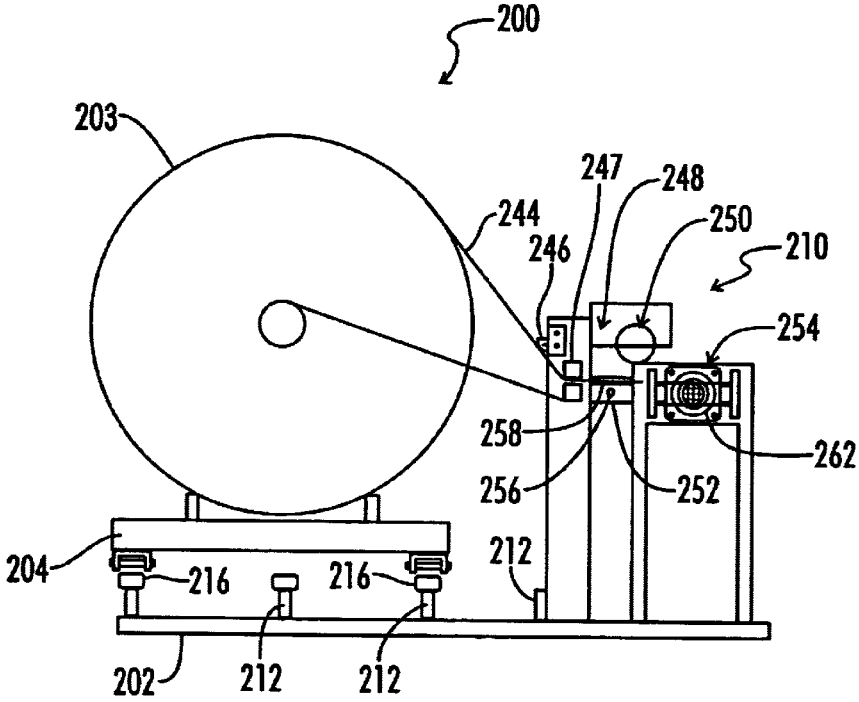
FIG. 2 is an end view of the wrapper supply roll holding, measuring, re-rolling, and cutting station.
Figure 2A:
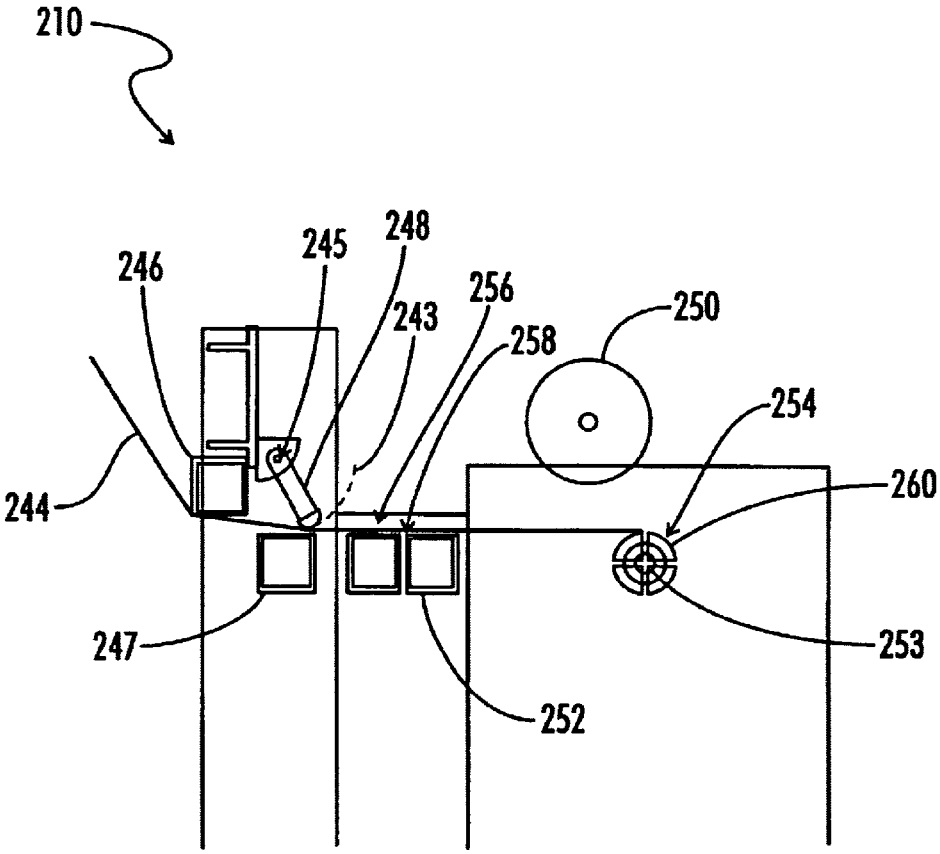
FIG. 2A is an end view at the web clamp, cutter guide, and roll up shaft.
Figure 3:
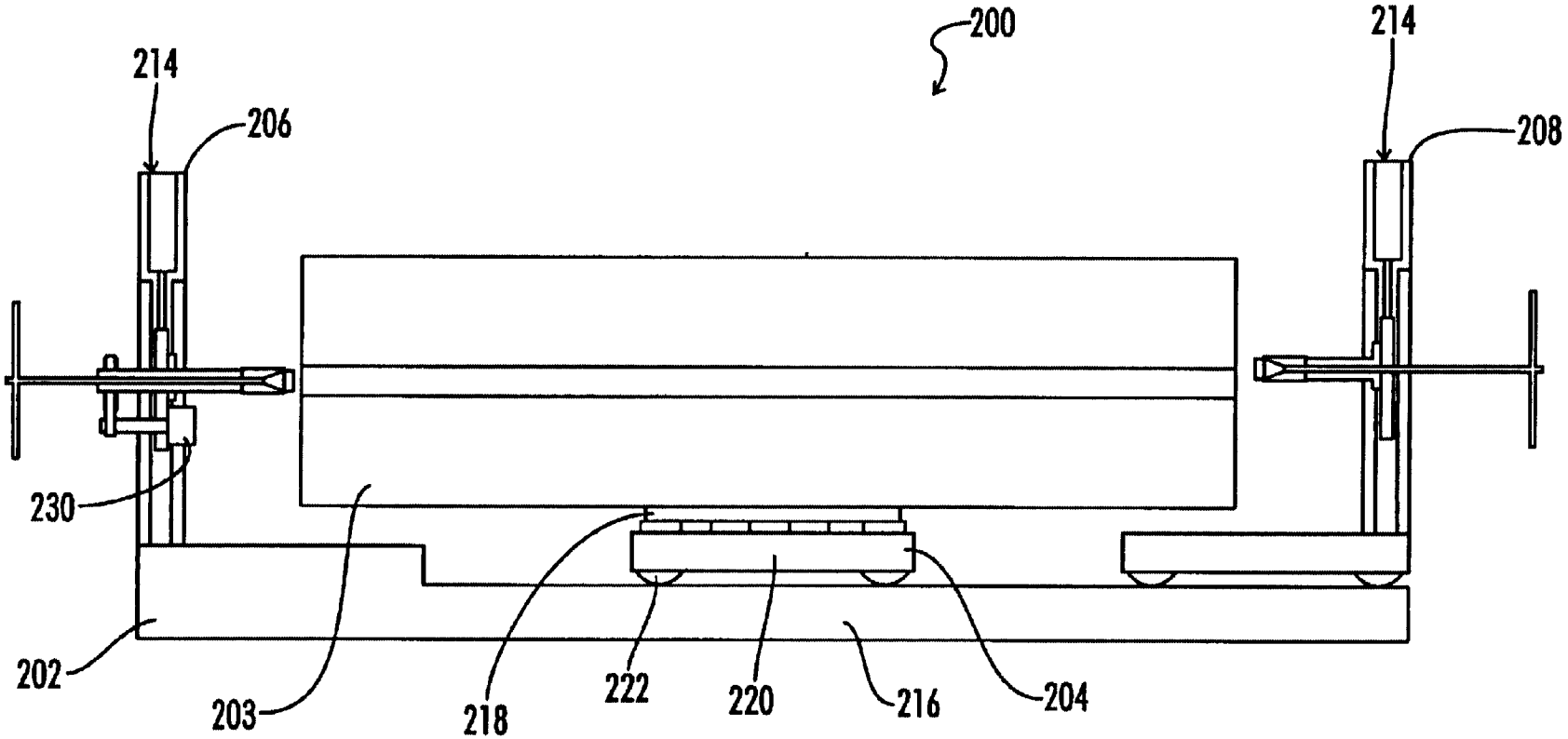
FIG. 3 is a cut away left side view of the wrapper supply roll holding, measuring, re-rolling, and cutting station.
Figure 4:
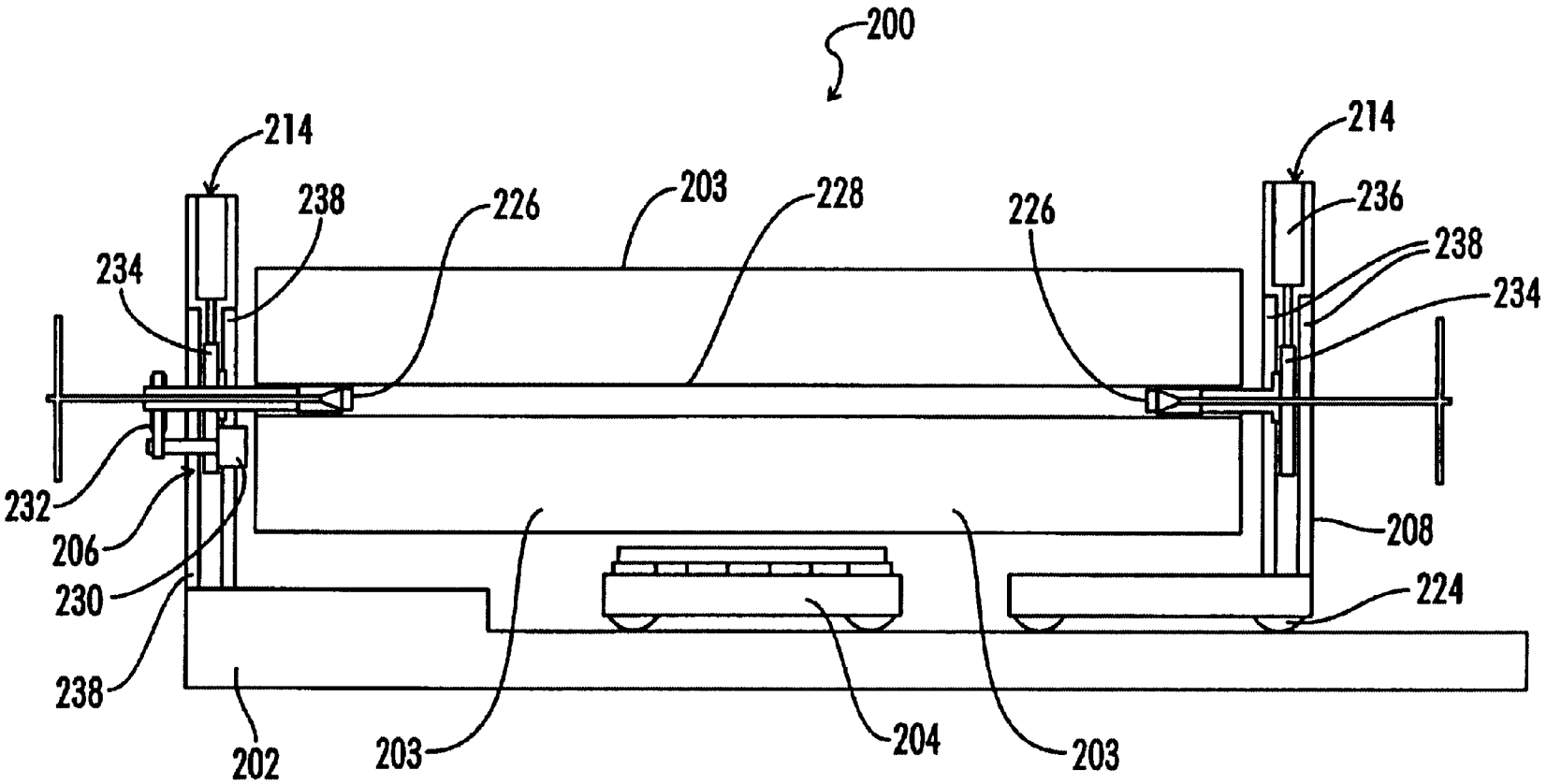
FIG. 4 is a cut away left side view of the wrapper supply roll holding, measuring, re-rolling, and cutting station with the roll lifted into position.

FIG. 2 is an end view of the wrapper supply roll station 200 showing a supply roll 203 loaded onto the carriage 204. FIG. 2A is a more detailed end view showing a web path through the guide 246, clamp 248, measuring wheel 250, and rollup shaft 254. The path of the supply material web 244 is shown going under a horizontal guide member 246, over a horizontal web clamp bar 247, under a pivoted web clamp 248, under a measuring wheel 250, over a cutting guide member 252, and finally onto roll-up shaft 254.

Figure 5:
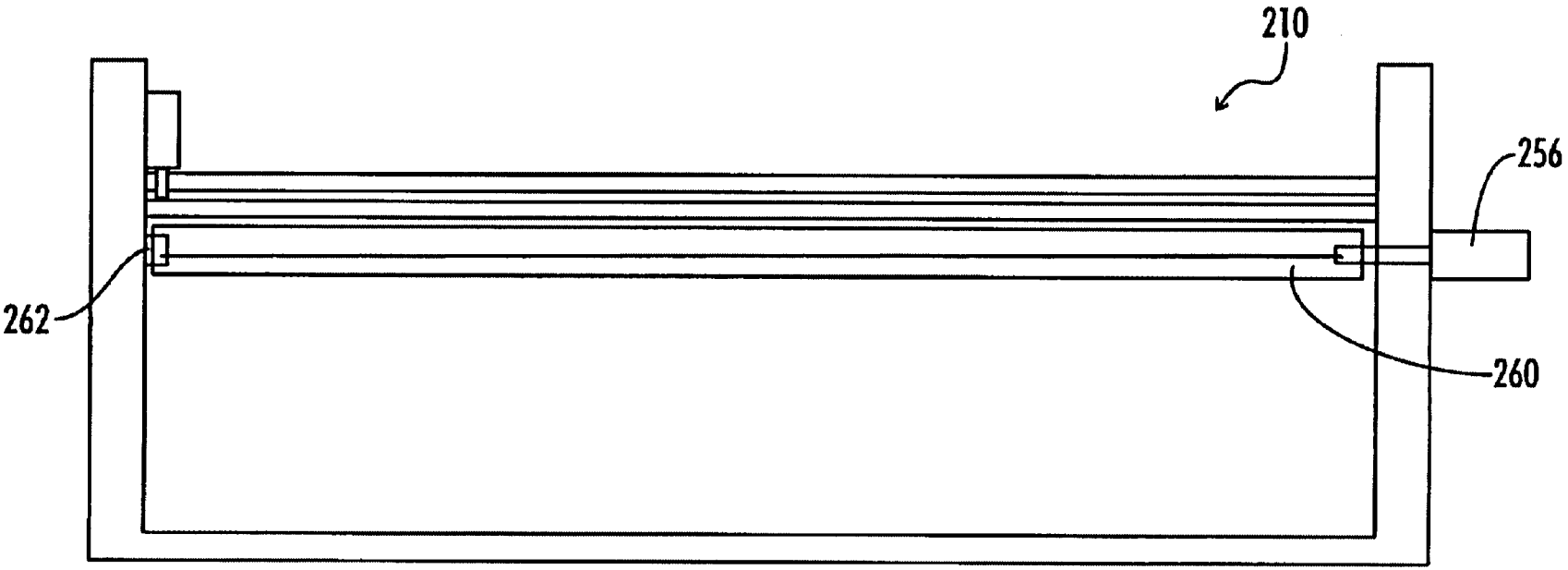
FIG. 5 is a right side view of the wrapper supply roll holding, measuring, re-rolling, and cutting station.

FIG. 5 shows a second hydraulic wrapper rotation motor 256 that pulls the wrapper web 244 from the supply roll 203 and turns the roll-up shaft 254. The roll rotation and wrapper motors 230, 256 are coordinated such that the supply roll 203 is rotated in harmony with the roll-up shaft 254 so as to maintain tension on the web 244 for a wrinkle free product during the transfer.

As shown in FIGS. 2, 2A, and 5, the measure wheel 250 is a commercially available instrument. The measure wheel 250 allows a preset length to be programmed into its controls to stops rotation of the supply roll 203 and roll up shaft 254 when the correct length of wrapper web 244 has been moved onto the roll up shaft 254.

A pivoted clamp 248 that is self actuated by gravity holds the supply wrapper web 244 in place against the horizontal web clamp bar 247. The guide-cutting member 252 includes an upper support area 256 with a slot 258 so that a knife may be used to sever the wrapper web 244 along the guide cutting member 252. The knife blade is pulled along the slot 258 such that the wrapper web 244 is supported on both sides of the slot 258. Pivoted clamp 248 prevents web 244 from being pulled from the guides when the web 244 is cut.

The roll-up shaft 254 has opposed longitudinal bars 260 that are cammed into an extended position by a cam activation device 253 when the shaft 254 is rotated. This effectively increases the diameter of the shaft 254. After the correct amount of wrapper 244 has been measured and cut from the supply roll 203, these bars 260 are retracted an end support 262 is disconnected to allow for an axial removal of the pre-cut wrapper 12. This results in a roll of approximately six to eight inches in diameter that maybe easily transported. Adhesive backed tape, not shown, is applied to the trailing edge of the pre-cut wrapper 12 to prevent unrolling. These pre-cut wrappers 12 may then be further packaged if they are to be shipped to a remote location. The pre-cut wrapper 12 may be cut to a new desired axial width by well known methods, such as the use of a circular saw.

Figure 6:
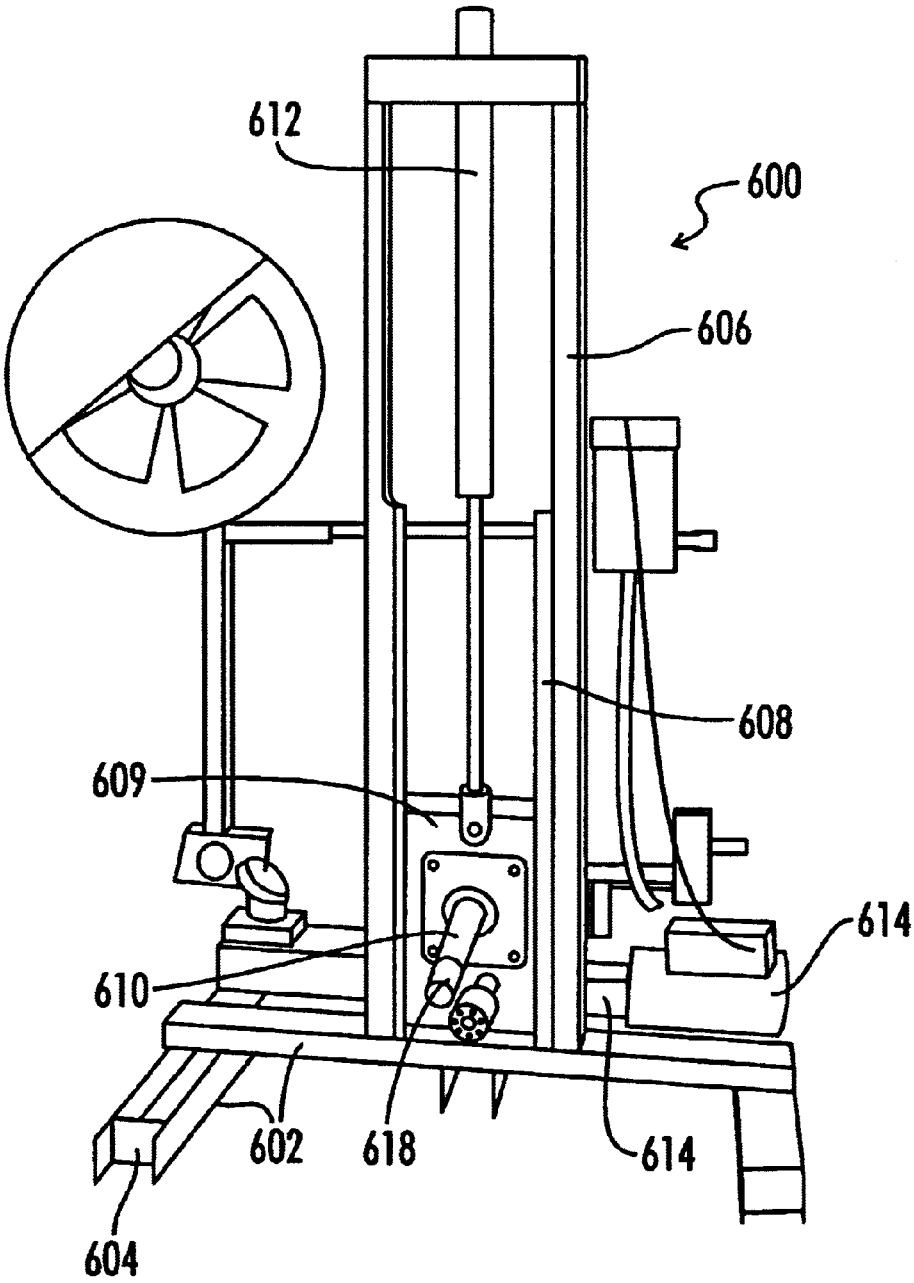
FIG. 6 is a front perspective view of one end the paper roll wrap station.
Figure 7:
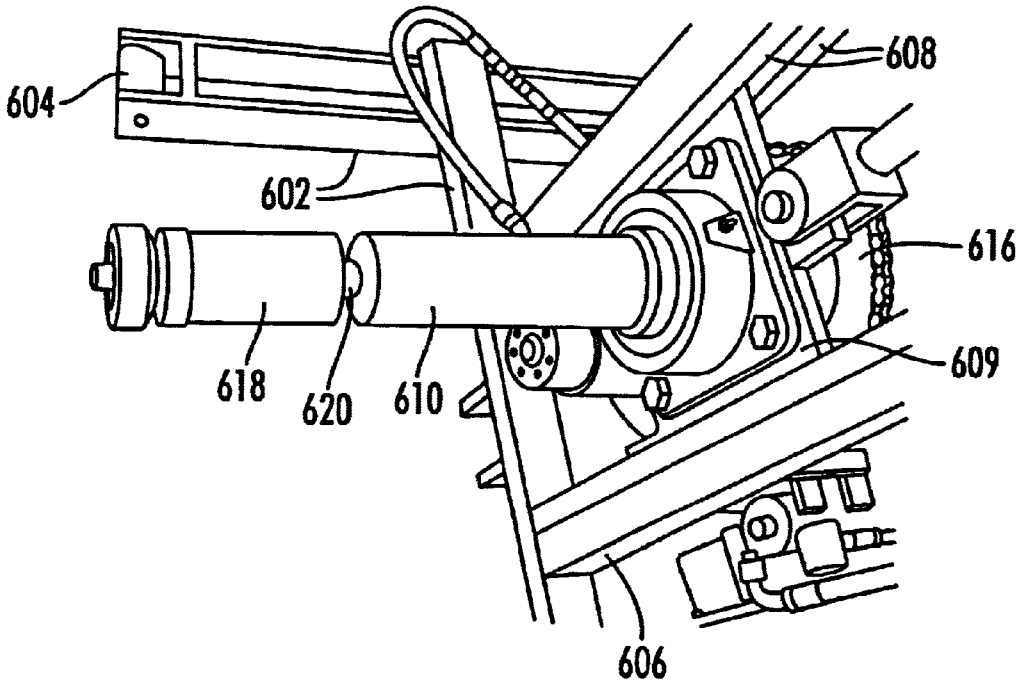
FIG. 7 is a top front perspective view of one end of the paper roll wrap station.
Figure 8:
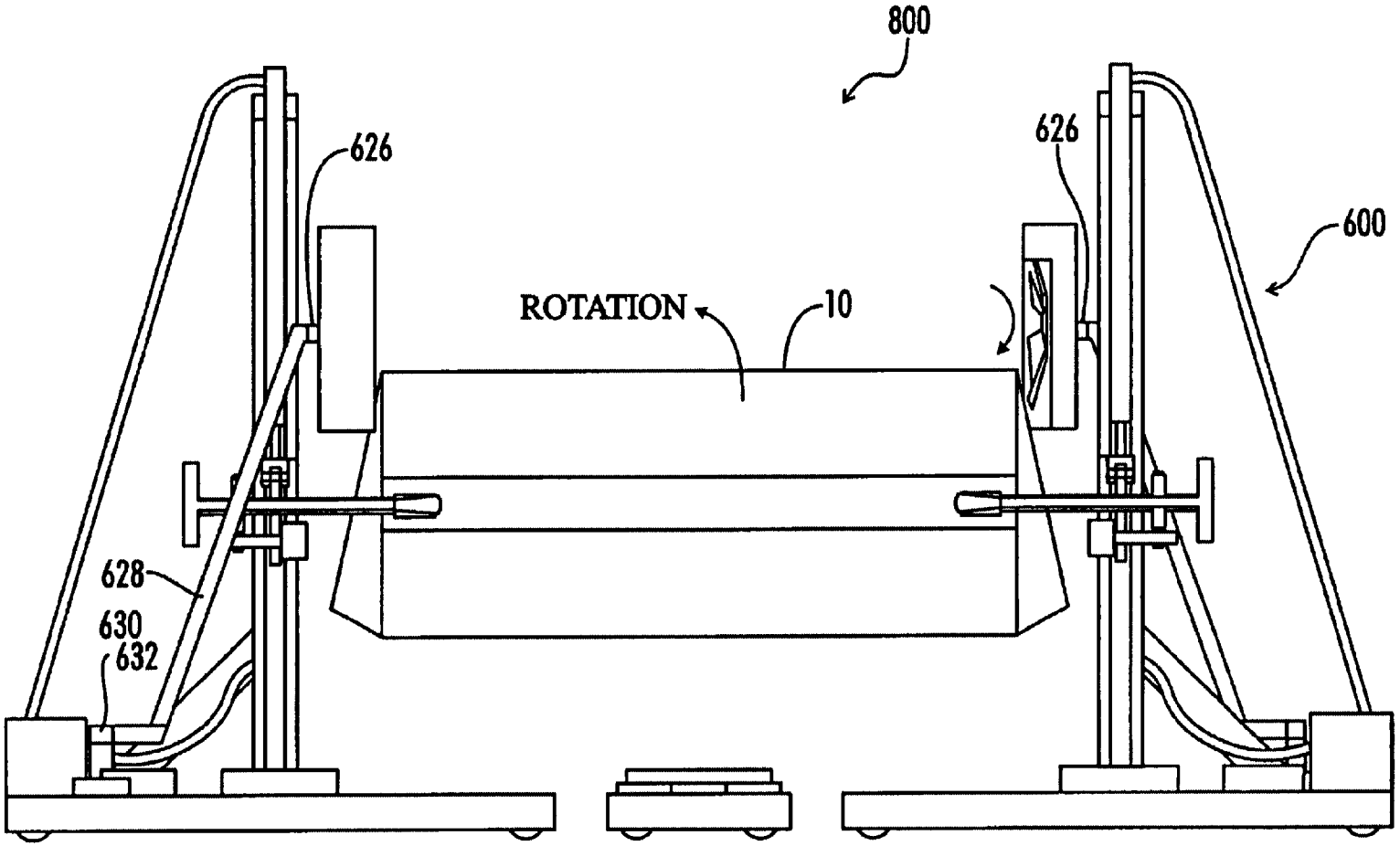
FIG. 8 is a side view of two paper roll wrap stations supporting a paper roll and folding the wrap edges.

FIGS. 6 and 7 show the wrapping carts 600 used in the paper roll wrap station 800 shown in FIG. 8. Two of these carts 600 are required to lift and rotate the paper roll 10 that is to be refurbished. Each cart 600 is identical consisting of a framework 602 mounted on rollers 604 for mobility. A vertical portion 606 of the frame 602 forms tracks 608 as a guide for a plate 609 supporting a powered spindle 610 that is attached to a vertically mounted hydraulic cylinder 612. Hydraulic motors 614 power the spindles 610 through drives 616, shown as a chain drives, which rotate the roll 10 during the wrapping procedure. Hydraulic motors 614 are powered by a hydraulic power unit consisting of an electric motor of approximately 1½ hp., a commercially available hydraulic pump, valves, and other standard components found in a hydraulic power system. Hydraulic motors 614 are connected to a gear reducer and a one way clutch which drives spindle 610. The clutch allows the motor to drive spindle 610 but prevents the pump from being turned backward by the spindle. The gear reducer output speed is about 54 rpm.

Figure 6A:
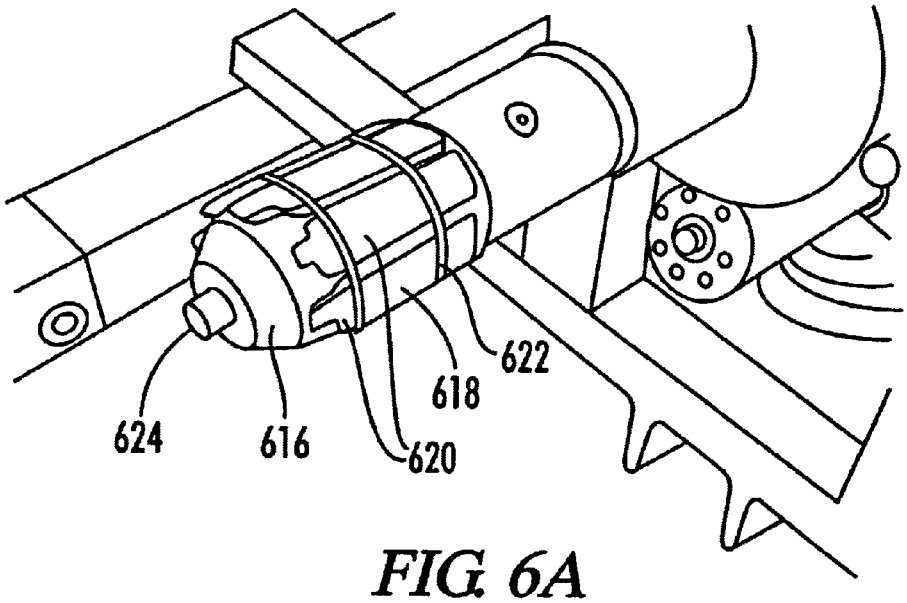
FIG. 6A is a top front perspective view of the expander spindle.

The carts 600 are positioned at each end of the paper roll. A header is placed onto the spindle 610 for use at a later time. The spindle 610 is then inserted into the ends of the rolls 10 and the roll 10 is then lifted using the spindle 610 and the grippers 618. As shown in FIG. 6A, a segmented gripper 618 of the correct size for the core tube of the paper roll 10 is placed on each spindle 610. The segmented gripper 618 is shown in FIG. 6A and includes a set of eight segments 620 held on by a ring 622 such that the segments 620 may expand the diameter of the spindle 610 to fit the inside diameter of the roll 10 core. Segments 620 fit on the small diameter adjustment shaft 624 of the spindle 610. Retracting this adjustment shaft 624 into the spindle 610 causes the segments 620 of the gripper 618 to expand to grip the interior 13 of the core tube 11 to prevent slippage. The most prevalent core sizes are 3" and 6" but other sizes may be accommodated.

Figure 9:
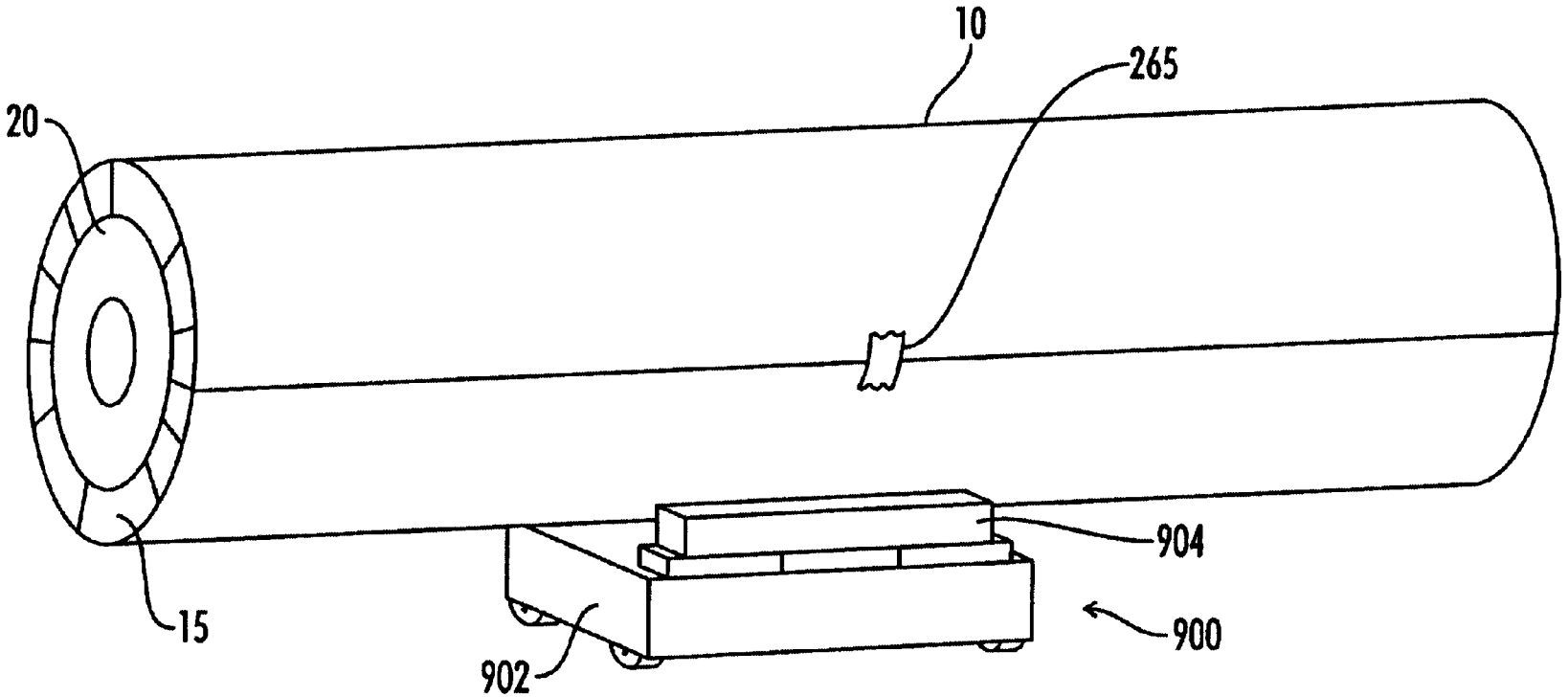
FIG. 9 is a side view of the roll transporter supporting a roll.

To lift the roll 10, the spindles are positioned so as to enter the hollow core tube 11 in the center of each roll 10. The spindles 610 are then elevated which lifts the paper roll 10 off of the floor. The front edge of a precut body wrapper 12 is attached to the paper roll 10 using tape (not shown). The spindle motors 614 then rotate the roll 10 causing the wrapper 12 to wind about the roll 10. The trailing edge of the wrapper 12 is then secured using an adhesive tape 265 as shown in FIG. 9. Note: a one-way clutch is utilized in the gearbox of each cart. This prevents the hydraulic motor 614 from being driven backwards and becoming a pump when it is driven in the opposite direction by the opposing drive motor as previously described.

As noted in the process of FIG. 1, the next step is to crimp the edges 14 of the resulting body wrapper 12 that overhangs the paper roll 10 by about six inches on each end 18. As shown in FIGS. 6 and 8, each cart 600 is equipped with a circular rotating element crimper 622, also known as a crimp disc 622, consisting of five blades 624, which is used to perform a crimp to the overhung body wrap material 14. A hydraulic disc motor 626 mounted to a frame 628 powers the crimper 622. This frame 628 is pivoted at pivots 630, 632 operating in two directions at the bottom of the frame 628. The rotational speed of the crimper is approximately 54 rpm.

As shown in FIG. 8, one pivot 630 allows the crimper 622 to rotate in toward the end 18 of the roll 10. This positions the plane of the crimping disc 622 in the same plane as the end 18 of the roll 10. The other pivot 632 allows the disc 622 to move parallel with the end 18 of the roll 10. In use, the crimper disc 622 is first rotated away from the outer diameter surface of the paper roll 10. When placed into motion, the roll 10 and the crimper 622 are both rotating. The crimper 622 is slowly pivoted into the roll 10 until the crimper 622 begins to bend the wrapper overhang 14 ninety (90) degrees to be parallel with the end 18 of the roll 10. A fold 15 or crimp is formed as the crimper 622 is pivoted toward the axis of the roll 10. The resulting folded over crimp retains the protective header 16 that will be inserted. A wireless foot switch 634 is used to control the rotation of the crimper 622. This eliminates the electrical cable and the associated hazards and inconveniences that would otherwise exist.

In order to allow use of the mobile roll wrapper from readily available electrical power, namely 120 volts 60 Hz operation in the United States, the size of the electric motors (1½ hp) for the hydraulic pumps are limited in size to prevent overloading of the circuits. Each cart may be connected to a separate electrical power supply circuit in order to prevent overloading of the circuits. This motor size limitation allows operation of either the roll motor 614 or the crimper motor 626, but would not allow the operation of both motors simultaneously off of the same low power circuit. To explain: When cart #1 rotates the roll, the opposite cart #2 powers the Crimper 622 on cart #2. The roles of the carts are then changed so that cart #2 turns the roll and cart #1 powers the Crimper 622 on cart #1. Thus only one motor per cart is connected to the electrical power source. This allows the use of both motors off of standard circuits for portable operation that does not require a fixed high power supply.

FIG. 9 shows the roll transporter 900. When the crimping operation is complete the roll 10 is lowered onto a modified version of a commercially available pallet jack 902 for transport to the header and cap clamping station 1000. This jack 902 is modified to retain the roll 10 with two uprights 904, one on each side of the jack 902, that retain the roll 10 on the pallet jack 902. Rollers 906 mounted to the jack 902 allow the jack 902 to be moved to the desired position for installing the header 16 and cap 20 end protection.

Figure 10:
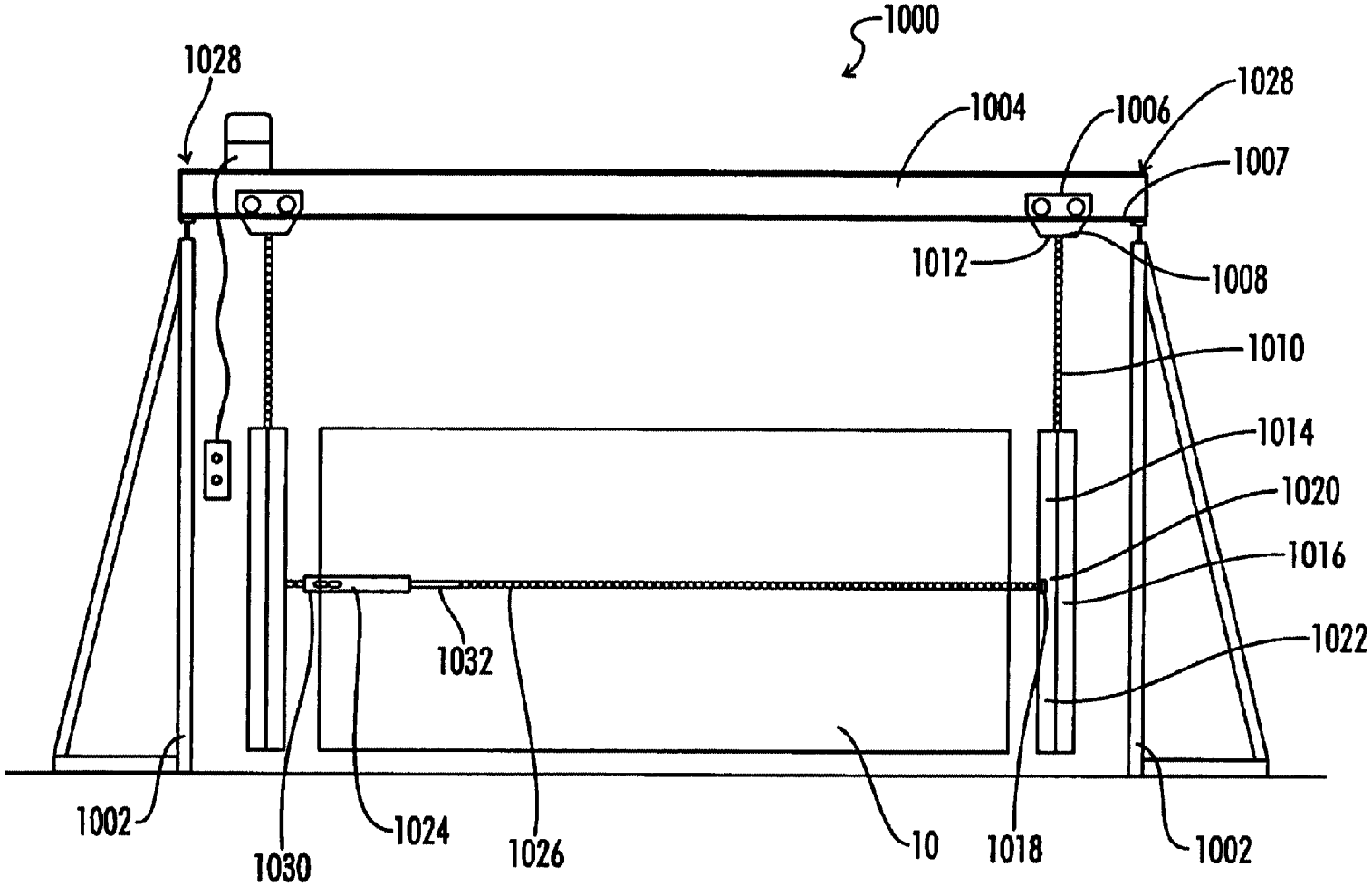
FIG. 10 is a side view of the header and cap clamping station.

FIG. 10 shows the header and cap clamping station 1000. The clamping station 1000 equipment consists of vertical end frames 1002 of structural steel that support an overhead steel beam 1004. Two commercially available lifting hoist trolleys 1006 ride on the lower flange 1007 of this beam 1004. This assembly is approximately 14-ft long×5-ft wide× 8-ft high. Attached to each trolley 1006 is a spreader bar 1008 of structural steel about 4-ft long. A holding chain 1010 is affixed to each end 1012 of this spreader bar 1008. These holding chains 1010 support a steel clamp plate 1014 that may assume various dimensions depending upon the size of the paper roll 10 being refurbished. A typical dimension may be 4–ft×5-ft. These plates 1014 are reinforced with structural steel shapes 1016 to reduce bending. A clevis 1018 is affixed at the mid-point 1020 and near the side edge 1022 of each of these two plates 1014.

Additional components include two hydraulic cylinders 1024 attached to a length of clamping chain 1026 on each side of the clamping station 1000. These cylinders 1024 have a stroke length of say 10-inches and are capable of exerting a force of up to 10,000 lbs. This force level is not required and is limited by controlling the hydraulic pressure.

The trolleys 1006 and attached clamp plates 1014 are moved toward the ends 1028 of the trolley beam 1004. A paper roll 10 previously rewrapped and crimped is moved under the clamping equipment 1000. Adhesive is applied to an end cap 20 and to the crimped body wrap 14. The end cap 20 is placed against the crimped wrap 14.

The trolleys 1006 are rolled toward the paper roll 10 until each clamp plate 1014 is against the end cap 20. One end 1030 of the pull-back cylinder 1024 is connected to a clevis 1018 on one clamp plate 1014. The other end 1032 of the cylinder 1024 connects to the chain 1026 that is affixed to a clevis 1018 on the opposite plate 1014. This connection is made with the cylinder 1024 extended.

Hydraulic pressure is applied to the cylinders 1024 on each side of the plates 1014 that retract, drawing the clamp plates 1014 against the paper roll 10. The control system uses a preset hydraulic pressure to stop the cylinders 1024, thus maintaining force against the roll end caps 20. This force is maintained for a recommended time period adequate to allow the adhesive to cure.

The clamp plates 1014 are released and the roll is removed from the clamping station 1000. Product identification labels (not shown) are applied thus completing the refurbishing process. The refurbished roll is then transported to an appropriate location.

A commercially available self-contained hydraulic power unit (#4ZC75 for ref only) is utilized to operate the clamp cylinders 1024. This is a ½ horsepower 120-volt unit capable of pressures adjustable to 10,000 psi. It is typically set at 3000 psi. for operating the clamp cylinders. The power unit is controlled by a pendant type control shown in FIG. 10 that allows the cylinders to be retracted and held in the clamped position and then extended to release the clamp plates.

Thus, although there have been described particular embodiments of the present invention of a new and useful Apparatus and Method for Paper roll Refurbishing, it is not intended that such references be construed as limitations upon the scope of this invention except as set forth in the following claims.

What is claimed is:

1. A portable equipment system for re-furbishing a paper roll, the portable equipment system comprising:

a wrapper supply roll station for unrolling, measuring, and re-rolling a supply roll to generate a roll cover, the wrapper supply roll station including two vertically adjustable rotatable spindles adapted to lift the supply roll and to unroll wrapper material from the supply roll;

a paper toll wrap station for lifting the paper roll and rotationally applying the roll cover to the paper roll, including crimping the edges of the roll cover over the ends of the paper roll, the paper roll wrap station including two vertically adjustable rotatable spindles adapted to lift the paper roll; and a header and cap damping station for applying a header and a cap to the paper roll, the header and can clamping station including:

first and second vertical end frames;

a beam supported by the first and second vertical end frames;

a first lifting hoist trolleys slideably positioned on the beam supporting a first clamp plate;

a second lifting hoist trolleys slideably positioned on the beam supporting a second clamp plate; and a clamp compression system connected to the clamp plates and adapted to apply a clamping force between the first and second clamp plates.

2. The system of claim 1, further comprising:

a roll transporter adapted to move the paper roll between the paper roll wrap station and the header and cap damping station.

3. An apparatus for holding and unrolling a supply roll and measuring an amount of unrolled wrapper material to create a desired length of wrapper material, the apparatus comprising:

a main frame including a plurality of tracks;

a loading carriage adapted to receive the supply roll and slideably move the supply roll along the tracks;

a first roll lift positioned on the main frame and adapted to engage the supply roll;

a second roll lift slideably positioned on the tracks and adapted to engage the supply roll;

each roll lift including a lilting mechanism having a vertically adjustable spindle adapted to lift the supply roll and to unroll wrapper material from the supply roll; and a wrapper measurer adapted to measure the amount of wrapper material that is unrolled from the supply roll.

4. The apparatus of claim 3, the lifting mechanism comprising:

a vertical frame supporting guide tracks;

a guide plate position fir guided operation within the guide tracks; and a hydraulic cylinder operatively connected to the vertical frame and adapted to move the guide plate within the vertical frame.

5. The apparatus of claim 4, the lifting mechanism further comprising:

rotationally mounting the spindle to the guide plate.

6. The apparatus of claim 5, the lifting mechanism further comprising:

a motor mounted on the guide plate and adapted to rotate the spindle.

7. An apparatus for rewinding unrolled wrapper material from a supply roll, comprising:

a wrapper roll shaft positioned to receive the unrolled wrapper material and adapted to roll the unrolled wrapper material into a rolled wrapper, the wrapper roll shaft including a diameter expansion device adapted to increase the effective diameter of the roll shaft while the unrolled wrapper material is being wound onto the roll shaft and decrease the effective diameter of the roll shaft for removal of the rolled wrapper.

8. The apparatus of claim 7, the diameter expansion device comprising:

opposed longitudinal bars connected to a cam activation device to expand and contract the bars.

9. The apparatus of claim 7, further comprising:

a wrapper guide positioned to direct the unrolled wrapper material from the supply roll to tile wrapper roll shaft.

10. The apparatus of claim 7, further comprising:

an unrolled wrapper cut station positioned between the supply roll and the wrapper roll shaft and adapted to provide a controlled severing of the unrolled wrapper material from the supply roll.

11. An apparatus for supporting a roll and for applying a roll cover to a roll, comprising:

a framework mounted on rollers, the framework including a vertical support with guide tracks;

a guide plate positioned for guided operation within the guide tracks; and a hydraulic cylinder operatively connected to the vertical support and adapted to wove the guide plate within the vertical support;

a vertically adjustable spindle rotationally mounted to the guide plate and positioned to support the roll cover; and a powered motor mounted an the guide plate and adapted to rotate the spindle.

12. The apparatus of claim 11, further comprising:

a crimper adapted to crimp roll cover over the end of the roll.

13. The apparatus of claim 12, the crimper comprising:

a support frame attached to the framework;

a circular rotating crimping element including blades rotationally mounted on the support frame;

a powered motor mounted on the support frame and adapted to rotate the circular rotating crimping element;

the support frame including at least two pivots, the first pivot adapted to allow the circular rotating crimping element to rotate to an end of the roll, and the second pivot adapted to allow the circular rotating crimping element to move parallel with the end of the roll to engage the roll cover overhanging the roll.

14. The apparatus of claim 13, further comprising:

a wireless foot switch connected to the powered motor and adapted to control the speed of tin powered motor with a hand-free operation.

15. An apparatus for retention of headers and caps under pressure during curing of a retaining adhesive, the apparatus comprising:

first and second vertical end frames;

a beam supported by the first and second vertical end frames;

a first lifting hoist trolleys slideably positioned on the beam supporting a first clamp plate;

a second lifting hoist trolleys slideably positioned on the beam supporting a second clamp plate;

a clamp compression system connected to the clamp plates and adapted to apply a clamping force between the first and second clamp plates; and wherein the clamp plates are suspended from the hoist trolleys by a spreader bar connected to a vertical suspension chain.

16. An apparatus for retention of headers and caps under pressure during curing of a retaining adhesive, the apparatus comprising:

first and second vertical end frames;

a beam supported by the first and second vertical end frames;

a first lifting hoist trolleys slideably positioned on the beam supporting a first clamp plate;

a second lifting hoist trolleys slideably positioned on the beam supporting a second clamp plate;

a claim compression system connected to the clamp plates and adapted to apply a clamping force between the first and second clamp plates; and wherein the clamp compression system includes at least one side chain connecting a powered hydraulic clamping cylinder between the first and second clamp plates.

17. A method for refurbishing a paper roll with wrapper material from a supply roll, the method comprising:

lifting the supply roll off of the ground with a portable supply roll lifter;

unrolling a measured amount of wrapper material from the Lifted supply roll;

re-rolling the unrolled wrapper material to create a roll cover for the paper roll with a portable rolling device;

lifting the paper roll with a portable paper roll lifting device;

rotationally applying the roll cover to the lifted paper roll;

crimping the edges of the roll cover over the ends of the paper roll with a portable crimping device;

applying a header to the paper roll;

adhesively applying a cap to the paper roll; and clamping the cap to the paper roll for a drying period with a portable clamping station.

18. The method of claim 17, further comprising:

moving the paper roll with a portable roll transporter.

* * * * *